United States Patent [19]

Norton

[11] 3,966,085

[45] June 29, 1976

[54] LOCKING TOP AND BOTTOM CONTAINER

[75] Inventor: Dale H. Norton, Gardena, Calif.

[73] Assignee: Roy Besser, Los Angeles, Calif.

[22] Filed: Nov. 10, 1975

[21] Appl. No.: 630,307

[52] U.S. Cl. ..... 220/327

[51] Int. Cl.[2] ..... B65D 45/00

[58] Field of Search ..... 220/315, 327, 328, 288, 220/4 E; 206/303, .83, .84; 138/96 R, 96 T, 91

[56] References Cited

UNITED STATES PATENTS

| | | | |
|---|---|---|---|
| 180,661 | 8/1876 | Sidey | 220/327 |
| 2,563,946 | 8/1951 | Law | 220/327 X |

*Primary Examiner*—George T. Hall

*Attorney, Agent, or Firm*—William W. Haefliger

[57] ABSTRACT

A locking top and bottom container comprises a. an upright cylindrical body having open upper and lower ends surrounded by rims, b. upper and lower discs closing and extending across said body upper and lower ends, respectively, c. retainer means extending axially within said body and having upper and lower connections to said upper end lower discs respectively, d. at least one of the connections to one disc being a threaded connection allowing rotation of the one disc in a tightening direction about said axis to peripherally tighten against one end rim of the body, and disc rotation in a loosening direction about said axis to loosen the one disc from the body allowing access to the body interior.

8 Claims, 4 Drawing Figures

LOCKING TOP AND BOTTOM CONTAINER

BACKGROUND OF THE INVENTION

This invention relates generally to hand held containers which may be locked in closed condition, and more particularly concerns a container having locking top and bottom closures which may be selectively removed. Such containers are useful to store articles in such manner that access to the container interior and the articles therein may only be had in an unobvious way.

SUMMARY OF THE INVENTION

A locking top and bottom container incorporating the invention basically comprises the following elements:

a. an upright cylindrical body having open upper and lower ends surrounded by rims, b. upper and lower discs closing and extending across said body upper and lower ends, respectively c. retainer means extending axially within said body and having upper and lower connections to said upper and lower discs respectively, d. at least one of the connections to one disc being a threaded connection allowing rotation of the one disc in a tightening direction about said axis to peripherally tighten against one end rim of the body, and disc rotation in a loosening direction about said axis to loosen the one disc from the body allowing access to the body interior.

As will be seen, a second of the connections to the second disc may be a threaded connection allowing rotation of the second disc in a tightening direction about the body axis to peripherally tighten against the opposite end rim of the body, as well as second disc rotation in a loosening direction to loosen the second disc from the body, allowing access to the body interior via the opposite end thereof. Further, the tightening directions of the two disc are preferably oppositely handed, about the body axis, so that tightening of both discs may be accomplished simultaneously and to equal extent.

Additional objects include the provision of a retainer shaft having oppositely threaded ends concealed within the container, such ends fitting interiorly threaded box connections on the discs; the provision of guides on the body projecting axially beyond the rims adjacent the body bore to fit within and guide on recess bores in the discs, thereby to center or align the discs as they are tightened; provision for stacking of body sections as enabled by the guides; and the provision of a grooved exterior on the body to appear of a thickness between grooves the same as each disc thickness, disguising the existence of the loosenable discs; and the design being especially adapted to a coin bank case, via a slot provided between successive body grooves.

These and other objects and advantages of the invention, as well as the details of an illustrative embodiment, will be more fully understood from the following description and drawings, in which:

DRAWING DESCRIPTION

DETAILED DESCRIPTION

Figure 1:
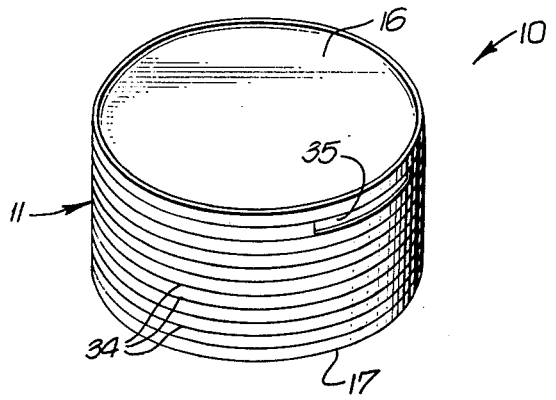
FIG. 1 is a perspective view of a container exhibiting the invention.
Figure 2:
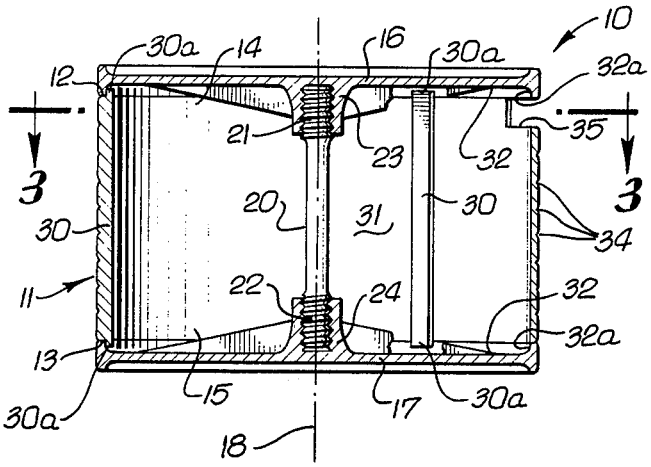
FIG. 2 is a vertical axial section through the FIG. 1 container.

In the drawings, the container 10 includes an upright cylindrical body 11 having upper and lower rims 12 and 13 surrounding end openings 14 and 15. Upper and lower discs 16 and 17 close the body by extending across those ends and seating against the rims. The outer diameters of the body and discs are the same.

Retainer means extends axially within the body and has upper and lower connections to the upper and lower discs, respectively. Further, at least one of the connections, i.e. a connection to one disc 16 is a threaded connection such as to allow rotation of disc 16 in a tightening direction about the body axis 18 to peripherally tighten against one rim 12 of the body; conversely, the threaded connection is such as to allow rotation of disc 16 in a loosening direction, to permit access to the container interior via end opening 14. A second connection, i.e. a connection to disc 17, is typically a threaded connection allowing rotation of the second disc 17 in a tightening direction about axis 18 to peripherally tighten against the opposite end rim 13 of the body; conversely the connection is such as to allow rotation of disc 17 in a loosening direction, i.e. to permit access to the container interior via end opening 15.

For ease of operation and mutual tightening of both closure discs, the upper disc tightening direction is clockwise about axis 18, whereas the lower disc tightening direction is counterclockwise.

These connection are most simply and effectively configured through provision of a concealed central axial shaft 20 having oppositely externally threaded ends 21 and 22, and interiorly threaded box connections 23 and 24 integral with the discs to threadably receive the shaft ends. Thus, each box connection may be unthreaded from its shaft end by sufficient rotation of the associated disc in a unthreading direction. Peripheral manual grasping of the disc to exert twist provides a high torque at the threaded connection to assure its release, no matter how tight it has been secured.

The body also has guides thereon, such as axial ribs 30, extending axially beyond the rims at 30*a*, and adjacent the body bore 31. Three such ribs are employed, for centering purposes. Each disc 16 and 17 has a recess 32 sunk therein and defining a bore 32*a* of the same diameter as the body bore. The guides at 30*a* fit the recesses and bear against the disc holes when the discs are tightened against the rims, thereby to axially align or center the discs relative to the body. Note that the guides are located at 120 degree intervals about axis 18.

Figure 4:
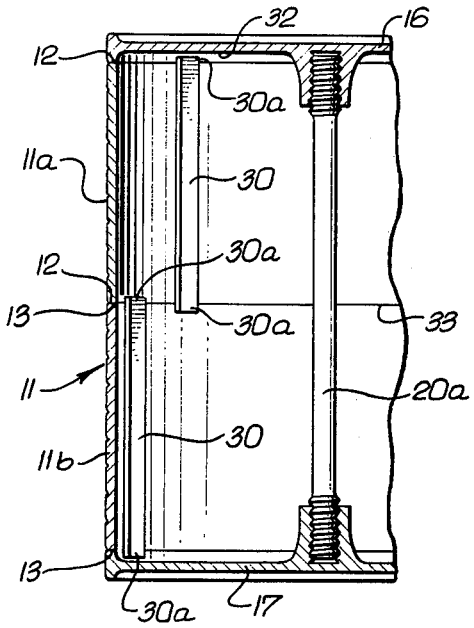
FIG. 4 is a fragmentary vertical section through body sections held in stacked relation by discs.
Figure 3:
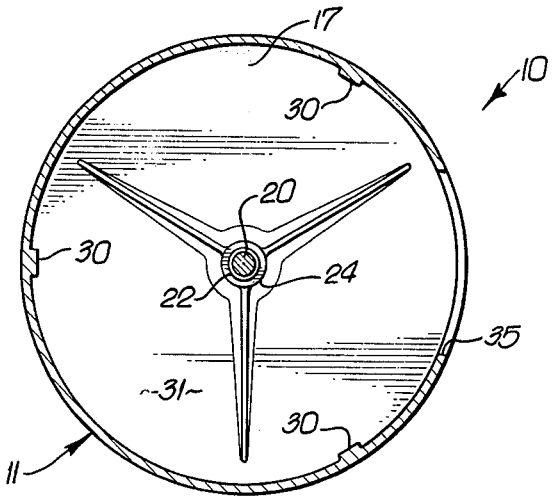
FIG. 3 is a horizontal section taken on lines 3—3 of FIG. 2.

FIG. 4 shows the body 11 in the form of two like sections 11*a* and 11*b*, and stacked end to end as facilitated by the interengaged rims 12 and 13, and guide rib extents 30*a* overlapping the joint 33 at the rims. The guide ribs on the two body sections are staggered or offset, angularly, about axis 18. The body sections are held together by the discs, the central shaft 20*a* being elongated.

Note that the FIG. 1 form of the container has peripheral annular grooves 34 which are axially spaced apart at equal distances, each of which is the same as the thickness of each disc 16 and 17. Accordingly, the presence of the discs is disguised, to add to the difficulty of ascertaining how to open the container. The container may be employed as a coin box, and for that purpose, a slot 35 may be formed in the side of the body 11, between two of the grooves 34.

I claim:

1. In a locking top and bottom container, a. an upright cylindrical body having open upper and lower ends surrounded by rims, b. upper and lower discs closing and extending across said body upper and lower ends, respectively, c. retainer means extending axially within said body and having upper and lower connections to said upper and lower discs respectively, d. at least one of the connections to one disc being a threaded connection allowing rotation of the one disc in a tightening direction about said axis to peripherally tighten against one end rim of the body, and disc rotation in a loosening direction about said axis to loosen the one disc from the body allowing access to the body interior.

2. The container of claim 1 wherein a second of the connections to the second disc is a threaded connection allowing rotation of the second disc in a tightening direction about said axis to peripherally tighten against the other end rim of the body, and second disc rotation in a loosening direction about said axis to loosen the second disc from the body allowing access to the body interior.

3. The container of claim 2 wherein said one disc tightening direction is clockwise about said axis, and said second disc tightening direction is counterclockwise about said axis.

4. The container of claim 3 wherein said retainer means includes a shaft having oppositely threaded ends, and interiorly threaded box connections on said discs to threadably receive said threaded ends.

5. The container of claim 1 wherein the body has guides thereon extending axially beyond said rims at the body bore, each disc having a recess therein defining a bore of the same diameter as the body bore, said guides fitting into said recesses and against said disc bores when the discs are tightened against said rims, thereby to axially align the discs relative to the body.

6. The container of claim 5 wherein the body includes two sections which are held in end to end stacked relation by said discs.

7. The container of claim 1 wherein the body contains peripheral annular grooves which are axially spaced apart at equal distances each of which is the same as the thickness of each disc.

8. The container of claim 7 wherein a coin slot is formed in the side of the body between two of said grooves.

* * * * *